US011626079B2

(12) United States Patent
Kim et al.

(10) Patent No.: US 11,626,079 B2
(45) Date of Patent: Apr. 11, 2023

(54) DISPLAY DEVICE AND METHOD FOR DRIVING THE SAME

(71) Applicant: LG Display Co., Ltd., Seoul (KR)

(72) Inventors: Sangkyu Kim, Paju-si (KR); Jaekyeong Yun, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/526,491

(22) Filed: Nov. 15, 2021

(65) Prior Publication Data

US 2022/0208115 A1 Jun. 30, 2022

(30) Foreign Application Priority Data

Dec. 31, 2020 (KR) ..... 10-2020-0188610

(51) Int. Cl.
*G09G 3/3266* (2016.01)
*G09G 3/3275* (2016.01)

(52) U.S. Cl.
CPC ..... *G09G 3/3275* (2013.01); *G09G 3/3266* (2013.01); *G09G 2300/0439* (2013.01); *G09G 2310/08* (2013.01); *G09G 2330/021* (2013.01)

(58) Field of Classification Search
CPC ..... G09G 3/3266; G09G 3/3275; G09G 2300/0426; G09G 2300/0439
See application file for complete search history.

(56) References Cited

U.S. PATENT DOCUMENTS

2018/0061296 A1* 3/2018 Shim ..... G09G 3/3258
2018/0286304 A1* 10/2018 Park ..... G09G 3/22
2019/0164491 A1* 5/2019 Kim ..... G09G 3/3233
2021/0202678 A1* 7/2021 Yuan ..... G09G 3/006
2022/0122529 A1* 4/2022 Meng ..... G09G 3/3233

FOREIGN PATENT DOCUMENTS

KR 10-1330415 B1 11/2013

* cited by examiner

*Primary Examiner* — Michael J Eurice
(74) *Attorney, Agent, or Firm* — Birch, Stewart, Kolasch & Birch, LLP

(57) ABSTRACT

A display device including a gate driver configured to apply gate signals to a plurality of gate lines; a data driver configured to apply data signals and a reference voltage to a plurality of data lines; and a display panel including a plurality of unit pixels, each unit pixel including a plurality of subpixels emitting different colors. Further, a first data line of the plurality of data lines is connected to a first subpixel and a second subpixel in a first unit pixel, and a second data line of the plurality of data lines is connected to the first subpixel and a third subpixel in the first unit pixel.

19 Claims, 8 Drawing Sheets

DISPLAY DEVICE AND METHOD FOR DRIVING THE SAME

CROSS REFERENCE TO A RELATED APPLICATION

The present application claims priority to Korean Patent Application No. 10-2020-0188610, filed Dec. 31, 2020 in the Republic of Korea, the entire contents of which are incorporated by reference into the present application.

BACKGROUND OF THE INVENTION

Field of the Invention

The present disclosure relates to a display device and a method for driving the same.

Description of the Related Art

An organic light emitting display device displays images by using an organic light emitting diode which generates light by a recombination of electrons and holes. Such an organic light emitting display device not only has a high response speed but also is driven at a low power consumption.

In addition, the organic light emitting display device includes pixels connected to data lines and scan lines. The pixels generally include an organic light emitting diode and a driving circuit for controlling an amount of current flowing to the organic light emitting diode. In particular, the driving circuit controls the amount of current flowing from a high potential driving voltage to a low potential driving voltage via the organic light emitting diode in response to a data signal. The organic light emitting diode then generates light with a predetermined luminance in response to the amount of flowing current.

Further, the display device includes a display area in which pixels are arranged and a non-display area in which a driving circuit is arranged. Recently, efforts are being made to reduce the size of the non-display area.

SUMMARY OF THE INVENTION

Accordingly, an object of the present invention is to address the above-noted and other problems.

Another object of the present invention is to reduce the size of the non-display area by reducing the number of data lines.

Another object of the present invention is to provide a display device having a structure in which adjacent subpixels share data lines, and a method for driving the same.

Still another object of the present invention is to provide a display device which can be driven by a double rate driving (DRD) method.

To achieve these and other advantages and in accordance with the purpose of the present invention, as embodied and broadly described herein, the present invention provides in one aspect a display device including a gate driver which applies gate signals to a plurality of gate lines; a data driver which applies data signals and a reference voltage to a plurality of data lines; and a display panel in which unit pixels which are connected to the plurality of gate lines and the plurality of data lines are arranged. Each of the unit pixels includes a plurality of subpixels which are connected to a first data line and a second data line. The first and second data lines are connected to the plurality of subpixels which are comprised in the unit pixel and are the same or different.

In addition, the first data line applies a first data signal to a first subpixel, and applies a second data signal to a second subpixel comprised in the same unit pixel as the first subpixel. Further, the second data line applies the first data signal to the first subpixel, and applies a reference voltage to a plurality of other subpixels which are comprised in the unit pixel and are the same as or different from the first subpixel.

Also, subpixels are connected to any one of a first gate line and a second gate line. Between adjacent unit pixels, the subpixels connected to the same gate line among the first gate line and the second gate line are connected to the same one second data line. In addition, the unit pixel includes a first unit pixel in which a first to a third subpixels are sequentially disposed and which are connected to the first data line and the second data line; and a second unit pixel in which a fourth to a sixth subpixels are sequentially disposed and which are connected to a third data line and a fourth data line.

Further, the unit pixel includes a first unit pixel in which a first to a third subpixels are sequentially disposed and which are connected to the first data line and the second data line; and a second unit pixel in which a fourth to a sixth subpixels are sequentially disposed and which are connected to a third data line and a fourth data line. The first subpixel and a second subpixel of the first unit pixel are connected to the first data line, and the third subpixel is connected to the second data line. The fourth and fifth subpixels of the second unit pixel are connected to the third data line, and the sixth subpixel is connected to the fourth data line.

The first subpixel of the first unit pixel and the fourth and sixth subpixels of the second unit pixel are further connected to the second data line. The second and third subpixels of the first unit pixel and the fifth subpixel of the second unit pixel are further connected to the fourth data line.

In another aspect, the present invention provides a method for driving a display device including a plurality of gate lines and unit pixels connected to the plurality of gate lines, each of the unit pixels comprising a plurality of subpixels connected to a first data line and a second data line, the first and second data lines connected to the plurality of subpixels which are comprised in the unit pixel and are the same or different.

The method includes applying a data signal to the first data line during a first period of one frame, and applying a reference voltage to the second data line; and applying a data signal to the first and second data lines during a second period of the one frame. The plurality of subpixels are connected to any one of a first gate line and a second gate line. A gate signal is applied to the first gate line during the first period. The gate signal is applied to the second gate line during the second period.

During the first period, the data signal is applied to at least some of the subpixels of a first unit pixel through the first data line and the reference voltage is applied to at least some of the subpixels of the first unit pixel through the second data line. During the second period, the data signal is applied to some of the remaining subpixels of the first unit pixel through the first and second data lines and the reference voltage is applied to some of the remaining subpixels of the first unit pixel through the second data line of a second unit pixel adjacent to the first unit pixel.

During the first period, the data signal is applied to at least some of the subpixels of a first unit pixel through the first and second data lines and the reference voltage is applied to at least some of the subpixels of a first unit pixel through the second data line of a second unit pixel adjacent to the first unit pixel. During the second period, the data signal is applied to some of the remaining subpixels of the first unit pixel through the first data line and the reference voltage is applied to some of the remaining subpixels of the first unit pixel through the second data line.

Further scope of applicability of the present invention will become apparent from the detailed description given hereinafter. However, the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

Figure 1:
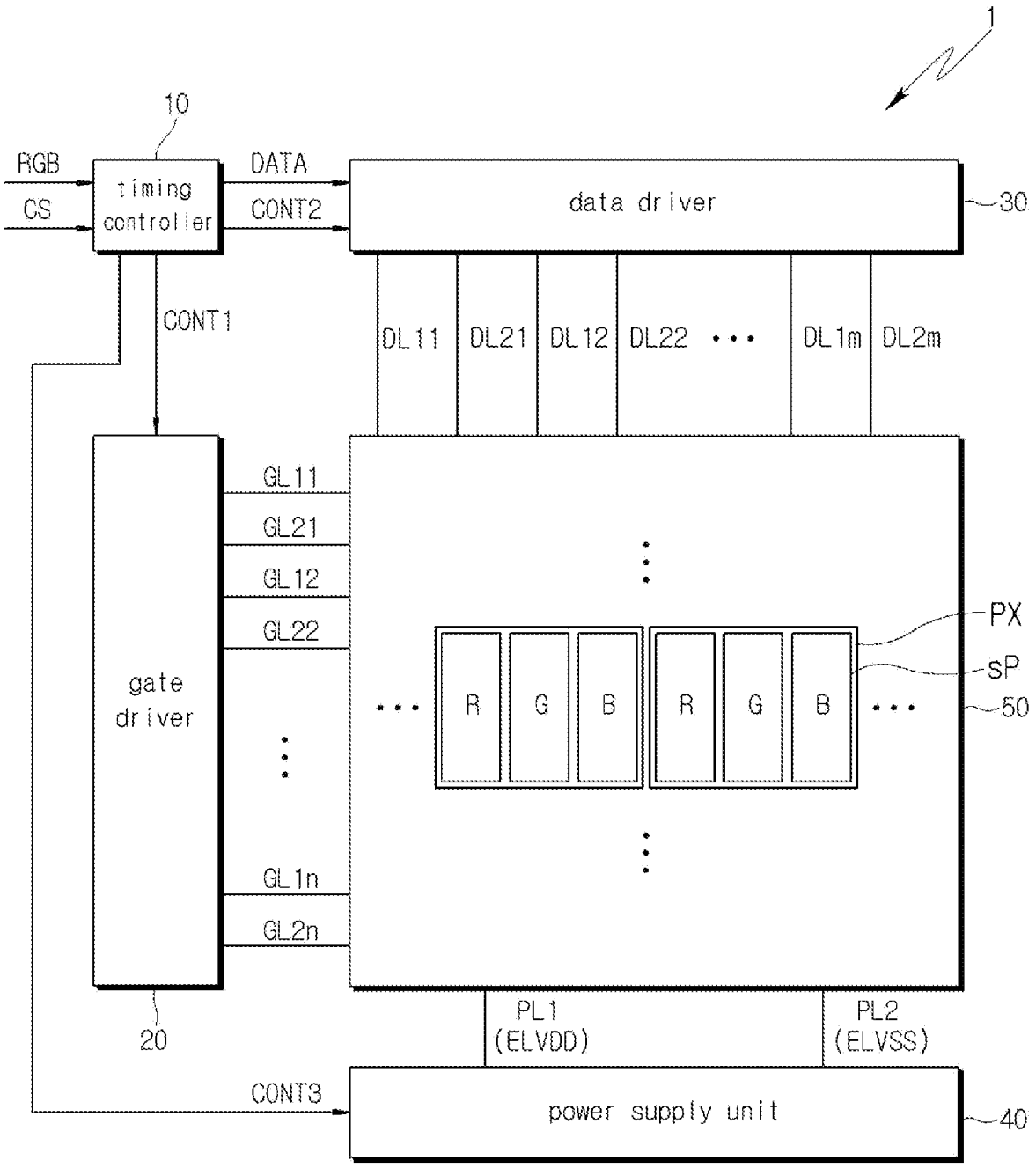
FIG. 1 is a block diagram illustrating a configuration of a display device according to an embodiment.

Reference will now be made in detail to the preferred embodiments of the present invention, examples of which are illustrated in the accompanying drawings.

The features, advantages and method for accomplishment of the present invention will be more apparent from referring to the following detailed embodiments described as well as the accompanying drawings. However, the present invention is not limited to the embodiment to be disclosed below and is implemented in different and various forms. In the following description, when it is mentioned that a portion is "connected" to another portion, it includes not only "is directly connected" but also "electrically connected" with another element placed therebetween. Also, in the drawings, parts irrelevant to the present invention will be omitted for a clear description of the present invention. Similar reference numerals will be assigned to similar parts throughout this patent document.

FIG. 1 is a block diagram illustrating a configuration of a display device 1 according to an embodiment. As shown, the display device 1 includes a timing controller 10, a gate driver 20, a data driver 30, a power supply unit 40, and a display panel 50. In addition, a plurality of subpixels sP are disposed on the display panel 50. The subpixels sP can be arranged, for example, in a matrix form on the display panel 50.

Further, as shown, each subpixel sP is electrically connected to a corresponding gate line GL11 to GL1*n* and GL21 to GL2*n* and a corresponding data line DL11 to DL1*m* and DL21 to DL2*m*. The subpixels sP thus can emit light with a luminance corresponding to gate signals and data signals supplied through the gate lines GL11 to GL1*n* and GL21 to GL2*n* and the data lines DL11 to DL1*m* and DL21 to DL2*m*.

In addition, each subpixel sP can also represent any one of a first to third colors. For example, each subpixel sP can represent any one of red (R), green (G), and blue (B) colors or can represent any one of cyan, magenta, and yellow colors. The subpixels sP representing the first to third colors can constitute one unit pixel PX. For example, the unit pixel PX can include red R, green G, and blue B subpixels sP arranged in a row direction.

In addition, the timing controller 10 receives an image signal RGB and a control signal CS from the outside. In particular, the image signal RGB can include a plurality of grayscale data, and the control signal CS can include, for example, a horizontal synchronization signal, a vertical synchronization signal, and a main clock signal.

The timing controller 10 then processes the image signal RGB and the control signal CS in conformity with operation conditions of the display panel 50, and generates and outputs an image data, a gate driving control signal CONT1, a data driving control signal CONT2, and a power supply control signal CONT3, as shown in FIG. 1.

Further, in FIG. 1, the gate driver 20 is connected to the unit pixels PX of the display panel 50 through a plurality of first gate lines GL11 to GL1*n* and a plurality of second gate lines GL21 to GL2*n*. As shown, one first gate line GL11 to Gln and one second gate line GL21 to GL2*n* are connected to one pixel row.

In addition, in one embodiment, the first gate lines GL11 to GL1*n* can be connected to some of the subpixels sP constituting one unit pixel PX, and the second gate lines GL21 to GL2*n* can be connected to the remaining subpixels sP. The type and the number of subpixels sP connected to the first gate lines GL11 to GL1*n* and the second gate lines GL21 to GL2*n* can be the same or different from each other between the unit pixels PX.

Further, the gate driver 20 can generate the gate signals based on the gate driving control signal CONT1 output from the timing controller 10. The gate driver 20 also provides the generated gate signals to the subpixels sP through the plurality of first gate lines GL11 to GL1*n* and the plurality of second gate lines GL21 to GL2*n*. In particular, the gate signal can be applied to a gate electrode of a switching transistor provided within the subpixels sP.

In addition, the gate driver 20 can sequentially apply the gate signal to the first and second gate lines GL11 to GL1*n* and GL21 to GL2*n* one by one during one frame period. For example, the gate driver 20 can apply the gate signal to the first gate lines GL11 to GL1*n* during the first half period of a frame, and can apply the gate signal to the second gate lines GL21 to GL2*n* during the second half period of the frame. In this way, the display device 1 is capable of double-rate driving.

Figure 4:
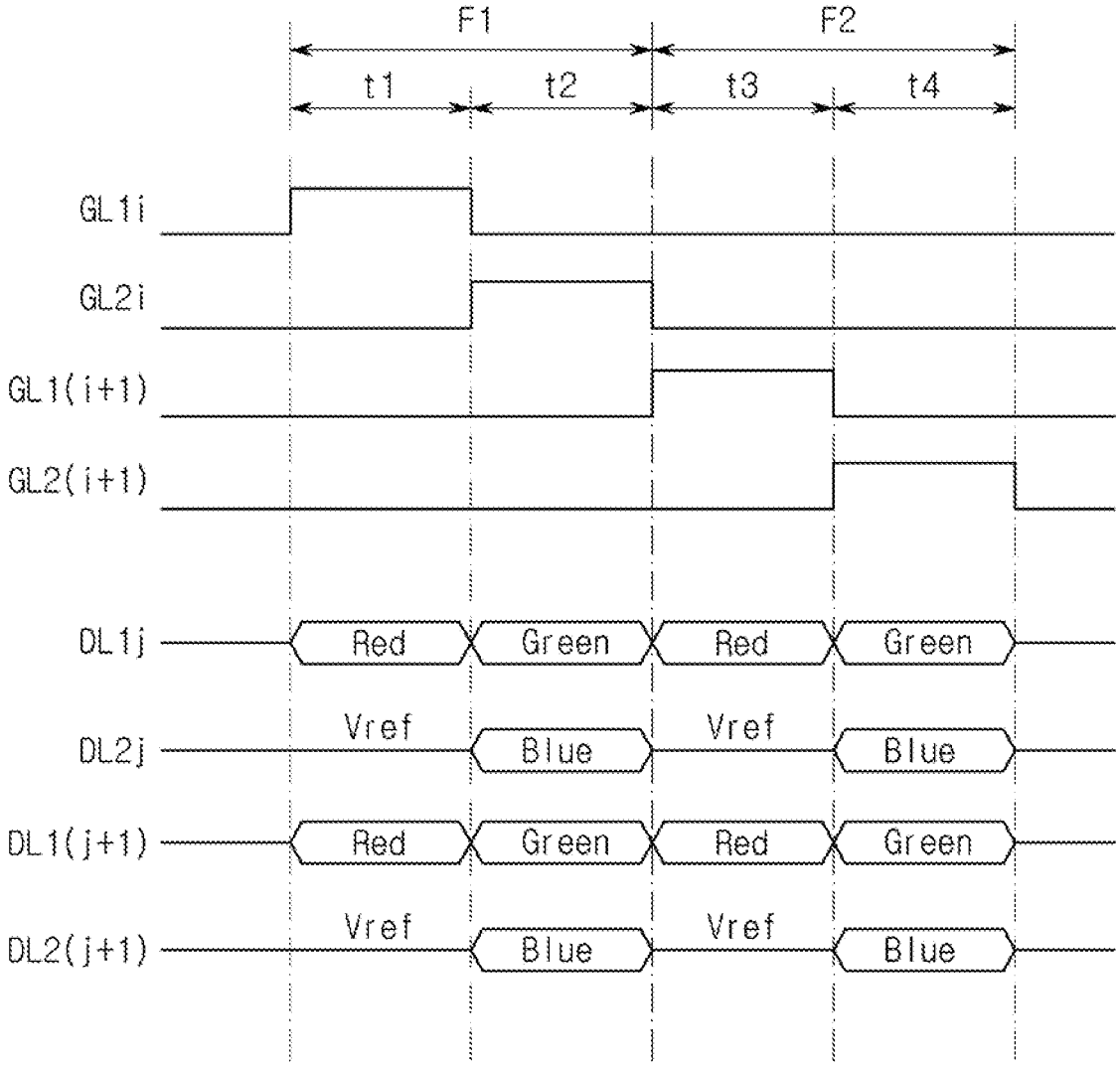
FIG. 4 is a timing diagram illustrating signals applied to the display device shown in FIG. 3.

In addition, the gate signal can be a square wave signal including a gate-on voltage (e.g., a low-level voltage for P-type transistors and a high-level voltage for N-type transistors) that turns on transistors included in the subpixels sP and a gate-off voltage (e.g., a high-level voltage for P-type transistors and a low-level voltage for N-type transistors) that turns off the transistors included in the subpixels sP. FIG. 4 illustrates one example of a square wave gate signal. In the following embodiments, a signal of the gate-on voltage can be represented as "a signal is provided," or "the provision of a signal starts." Also, a signal of the gate-off voltage is applied can be represented as "a signal is not applied," or "the provision of a signal is stopped (terminated)."

Further, the data driver 30 can be connected to the unit pixels PX of the display panel 50 through a plurality of first data lines DL11 to DL1*m* and a plurality of second data lines DL21 to DL2*m*. Also, the first one data line DL11 to DL1*m* and the second one data line DL21 to DL2*m* can be connected to one pixel column.

The plurality of first data lines DL11 to DL1*m* are provided to apply a data signal to the subpixels sP. Also, the plurality of second data lines D21 to D2*m* are provided to apply a data signal or a reference voltage to the subpixels sP. In this embodiment, the first one data line DL11 to DL1*m* can be connected to two or more subpixels sP. The subpixels sP connected to the first one data line DL11 to DL1*m* can be included in the same unit pixel PX.

Meanwhile, the second one data line DL21 to DL2*m* can be connected to two or more subpixels sP. Here, the subpixels sP connected to the second one data line DL21 to DL2*m* can be included in one unit pixel PX or can be included in different unit pixels PX.

In addition, the data driver 30 can generate data signals based on the data driving control signal CONT2 and the image data output from the timing controller 10. The data driver 30 can also provide the generated data signals to the subpixels sP through the plurality of the first and second data lines DL11 to DL1*m* and DL21 to DL2*m*. In particular, the data signals can be applied to the subpixels sP of the pixel column selected by the first or second gate signal. To this end, the data driver 30 can supply the data signals to the plurality of the first and second data lines DL11 to DL1*m* and DL21 to DL2*m* to be synchronized with the first or second gate signal.

Also, the data driver 30 can apply a reference voltage to the subpixels sP of the pixel column selected by the first or second gate signal. To this end, the data driver 30 can supply the reference voltage to the plurality of second data lines DL21 to DL2*m* to be synchronized with the first or second gate signal.

Further, as shown in FIG. 1, the power supply unit 40 can be connected to the subpixels sP of the display panel 50 through a plurality of power lines PL1 and PL2. The power supply unit 40 can thus generate a driving voltage to be provided to the display panel 50 based on the power supply control signal CONT3. As shown in FIG. 1, the driving voltage can include, for example, a high potential driving voltage ELVDD and a low potential driving voltage ELVSS. The power supply unit 40 can then provide the generated driving voltages ELVDD and ELVSS to the subpixels sP through the corresponding power lines PL1 and PL2.

In addition, the timing controller 10, the gate driver 20, the data driver 30, and the power supply unit 40 can be each composed of a separate integrated circuit (IC), or can be configured as an IC in which at least some of them are integrated. For example, at least one of the data driver 30 and the power supply unit 40 can be configured as an IC integrated with the timing controller 10.

Also, although the gate driver 20 and the data driver 30 are illustrated as separate components from the display panel 50 in FIG. 1, at least one of the gate driver 20 and the data driver 30 can be implemented in an in-panel method where the driver is formed integrally with the display panel 50. For example, the gate driver 20 can be formed integrally with the display panel 50 in a gate-in-panel (GIP) method.

Figure 2:
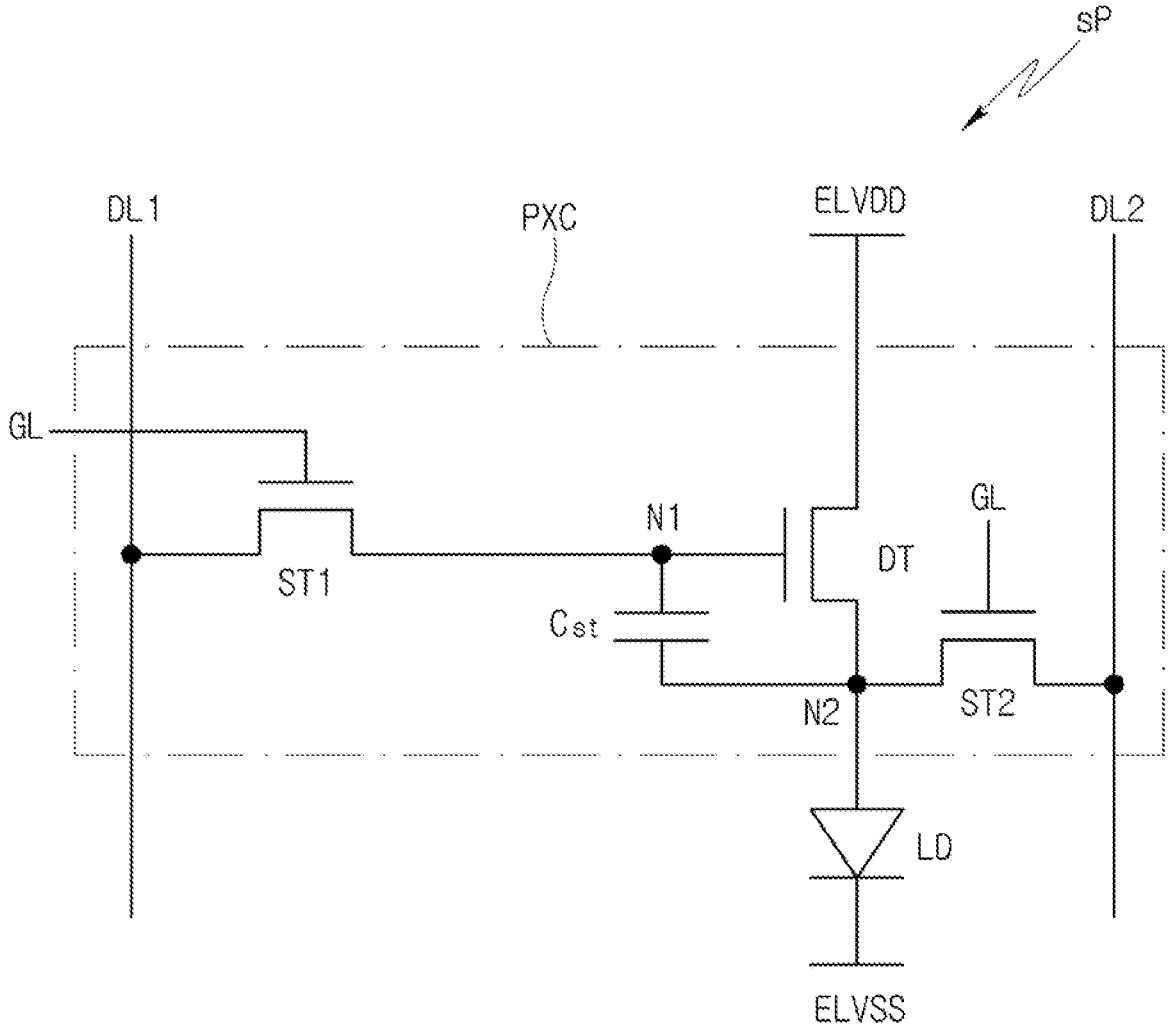
FIG. 2 is a circuit diagram illustrating an embodiment of a pixel shown in FIG. 1.

Next FIG. 2 is a circuit diagram showing an embodiment of the subpixel shown in FIG. 1. Referring to FIG. 2, the subpixel sP can include a light emitting device LD and a pixel circuit PXC for controlling the amount of current supplied to the light emitting device LD.

As shown in FIG. 2, an anode electrode of the light emitting device LD is connected to the pixel circuit PXC, and a cathode electrode of the light emitting device LD is connected to the low potential driving voltage ELVSS. The light emitting device LD then generates light with a predetermined luminance in response to the current supplied from the pixel circuit PXC.

Further, the pixel circuit PXC supplies a predetermined current to the light emitting device LD in response to the data signal supplied through the first data line DL1. To this end, the pixel circuit PXC can include a first switching transistor ST1, a second switching transistor ST2, a driving transistor DT, and a storage capacitor Cst.

Also, as shown, a first electrode (e.g., a drain electrode) of the first switching transistor ST1 is electrically connected to the first data line DL1, and a second electrode (e.g., a source electrode) of the first switching transistor ST1 is electrically connected to a first node N1. A gate electrode of the first switching transistor ST1 is electrically connected to the gate line GL. Here, the gate line GL can be the first gate lines GL11 to GL1*n* or the second gate lines GL21 to GL2*n* shown in FIG. 1. The first switching transistor ST1 is turned on when the gate signal of a gate-on level is applied to the gate line GL, and the first switching transistor ST1 transmits the data signal applied to the first data line DL1 to the first node N1.

Further, a first electrode (e.g., a drain electrode) of the second switching transistor ST2 is electrically connected to the second data line DL2, and a second electrode (e.g., a source electrode) of the second switching transistor ST2 is electrically connected to a second node N2. Also, a gate electrode of the second switching transistor ST2 is electrically connected to the gate line GL. The second switching transistor ST2 is then turned on when the gate signal of the gate-on level is applied to the gate line GL, and the second switching transistor ST2 transmits the reference voltage applied to the second data line DL2 to the second node N2.

In the above embodiment, the first switching transistor ST1 and the second switching transistor ST2 are connected to the same gate line GL, and can be simultaneously turned on in response to the gate signal. When the gate signal is applied, the data signal can be applied to the first node N1 through the first switching transistor ST1, and simultaneously, the reference voltage can be applied to the second node N2 through the second switching transistor ST2.

In addition, a first electrode of the storage capacitor Cst is electrically connected to the first node N1, and a second electrode of the storage capacitor Cst is electrically connected to the second node N2. The storage capacitor Cst can then be charged with a voltage corresponding to a voltage difference between the first node N1 and the second node N2.

Further, a first electrode (e.g., a drain electrode) of the driving transistor DT is configured to receive the high potential driving voltage ELVDD, and a second electrode (e.g., a source electrode) of the driving transistor DT is electrically connected to the second node N2, i.e., the anode electrode of the light emitting device LD. Also, a gate electrode of the driving transistor DT is electrically connected to the first node N1. The driving transistor DT can then control the amount of driving current flowing through the light emitting device LD in response to a voltage difference between the gate electrode and the source electrode.

In addition, the structure of the subpixels sP is not limited to what is shown in FIG. 2. For example, the subpixels sP can further include at least one element for compensating a threshold voltage of the driving transistor DT or initializing the voltage of the gate electrode of the driving transistor DT and/or the voltage of the anode electrode of the light emitting device LD.

In one embodiment, the second data line DL2 which applies the reference voltage to the subpixel sP can be connected to the unit pixel PX to which the subpixel sP belongs. In another embodiment, the second data line DL2 which applies the reference voltage to the subpixel sP can be connected to another adjacent unit pixel PX.

Also, although the foregoing has described that the subpixel sP receives the data signal through the first data line DL1 and receives the reference voltage through the second data line DL2, the present embodiment is not limited thereto. That is, the subpixel sP can receive the data signal through the second data line DL2. Further, the subpixel sP can be configured to receive the reference voltage through the second data line DL2 of another adjacent subpixel sP.

In addition, FIG. 2 shows an example in which the first switching transistor ST1, the second switching transistor ST2, and the driving transistor DT are NMOS transistors. However, the present invention is not limited thereto. For example, at least some or all of the transistors constituting each subpixel sP can be composed of a PMOS transistor. Also, various embodiments, each of the first switching transistor ST1, the second switching transistor ST2, and the driving transistor DT can be implemented with a low temperature poly silicon (LTPS) thin film transistor, an oxide thin film transistor, or a low temperature polycrystalline oxide (LTPO) thin film transistor.

Figure 3:
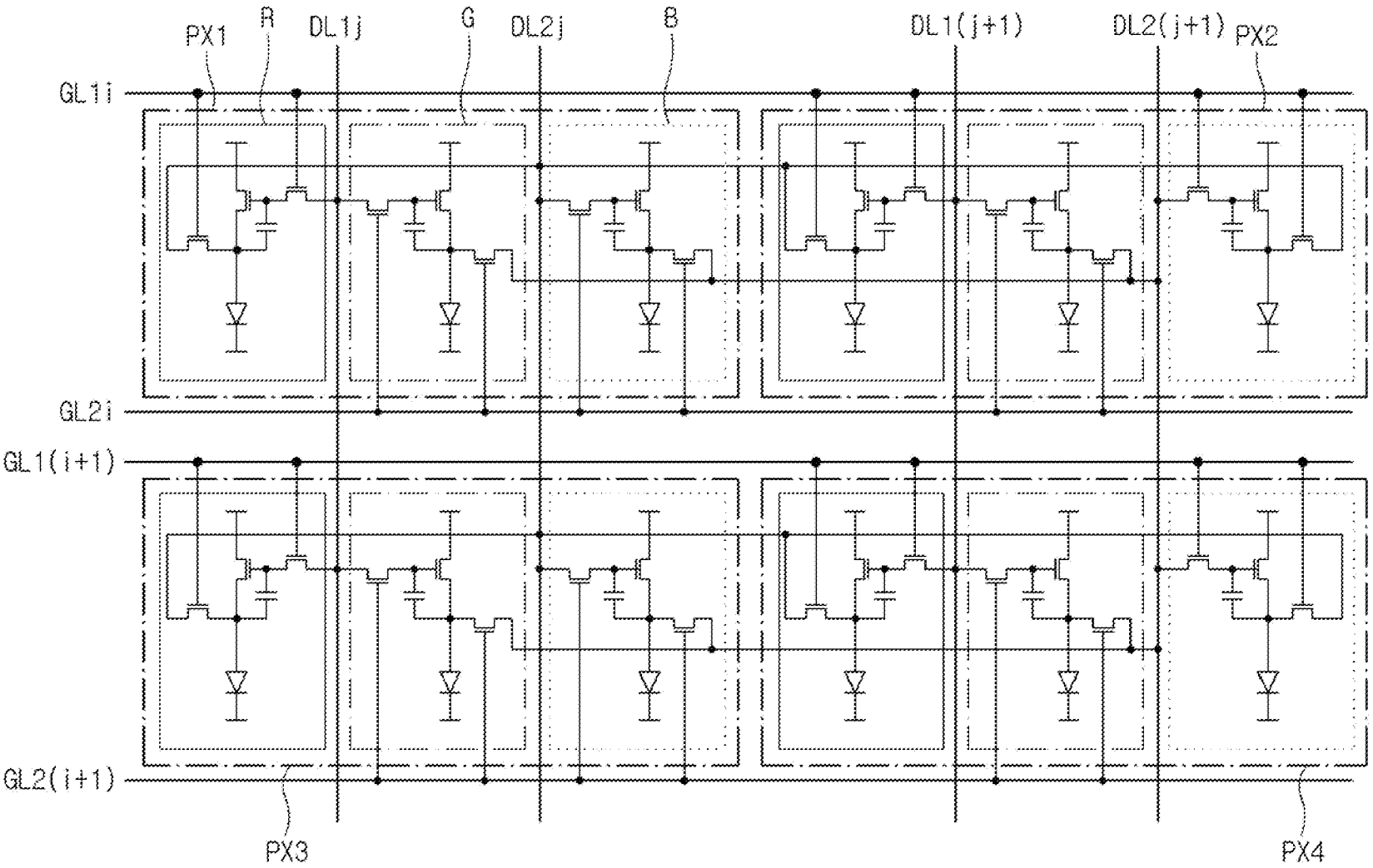
FIG. 3 is a plan view of a display panel according to an embodiment in which subpixels and wirings are disposed.

Next, FIG. 3 is a plan view of the display panel according to an embodiment in which the subpixels and wirings are disposed. In this embodiment, the display device 1 is configured by a double rate driving (DRD) method. That is, the subpixels R, G, and B disposed in one pixel row are connected to two gate lines GL1*i*, GL2*i*, GL1(*i*+1), and GL2(*i*+1), and the subpixels sP are driven by using 2k/3 data lines DL1*j*, DL2*j*, DL1(*j*+1), and DL2(*j*+1) (where k is the number of subpixels sP arranged in one pixel row). The DRD method can minimize a flicker phenomenon of the display panel 50 and minimize power consumption.

FIG. 3 shows four unit pixels PX1 to PX4 connected to an i-th pixel row, an i+l-th pixel row, a j-th pixel column, and a j+1-th pixel column. One unit pixel PX is composed of three subpixels R, G, and B which display red, green, and blue colors, respectively. For the DRD method, the subpixels R, G, and B are connected to the two gate lines GL1*i*, GL2*i*, GL1(*i*+1), and GL2(*i*+1). For example, some of the subpixels R, G, and B can be connected to the first gate lines GL1*i* and GL1(*i*+1), and some of the remaining subpixels R, G, and B can be connected to the second gate lines GL2*i* and GL2(*i*+1). The types and numbers of the subpixels R, G, and B connected to the first gate lines GL1*i* and GL1(*i*+1) and the second gate lines GL2*i* and GL2(*i*+1) between adjacent unit pixels PX1 to PX4 can be the same or different.

As shown in the embodiment in FIG. 3, the red subpixel R of the first unit pixel PX1 and the third unit pixel PX3 is connected to the first gate lines GL1*i* and GL1(*i*+1), and the green and blue subpixels G and B of the first unit pixel PX1 and the third unit pixel PX3 are connected to the second gate lines GL2*i* and GL2(*i*+1). Further, the red and blue subpixels R and B of the second unit pixel PX2 and the fourth unit pixel PX4 are connected to the first gate lines GL1*i* and GL1(*i*+1), and the green subpixel G of the second unit pixel PX2 and the fourth unit pixel PX4 is connected to the second gate lines GL2*i* and GL2(*i*+1). However, the present embodiment is not limited thereto.

For the DRD method, the subpixels sP are driven by using 2k/3 data lines DL1*j*, DL2*j*, DL1(*j*+1), and DL2(*j*+1). For example, three subpixels R, G, and B constituting one unit pixel PX1 to PX4 can receive a data signal by using two data lines DL1*j*, DL2*j*, DL1(*j*+1), and DL2(*j*+). The data signal is applied to the first switching transistor ST1 within the subpixels R, G, and B.

In this embodiment, at least two subpixels R and G among the three subpixels R, G, and B constituting one unit pixel PX1 to PX4 can share the data lines DL1*j* and DL1(*j*+1) (hereinafter, referred to as the first data line). One subpixel R of the subpixels R and G sharing the first data lines DL1*j* and DL1(*j*+1) is connected to the first gate lines GL1*i* and GL1(*i*+1), and the other subpixel G is connected to the second gate lines GL2*i* and GL2(*i*+1). Accordingly, when the gate signal is applied to one subpixel R of the subpixels R and G sharing the first data lines DL1*j* and DL1(*j*+1) through the first gate lines GL1*i* and GL1(*i*+1), the data signal can be applied to the one subpixel R through the first data lines DL1*j* and DL1(*j*+1), and when the gate signal is applied to the other subpixel G through the second gate lines GL2*i* and GL2(*i*+2), the data signal can be applied to the subpixel G through the first data lines DL1*j* and DL1(*j*+1).

Some of 2k/3 data lines DL1*j*, DL2*j*, DL1(*j*+1), and DL2(*j*+1) can be used to apply a reference voltage to the subpixels sP. For example, any one DL2*j* and DL2(*j*+1) (hereinafter, referred to as the second data line) of the two data lines DL1*j*, DL2*j*, DL1(*j*+1), DL2(*j*+1) connected to one unit pixel PX1 to PX4 can apply a reference voltage to the second switching transistor ST2 of the subpixels R, G, and B. The second data lines DL2*j* and DL2(*j*+1) which applies the reference voltage can be the data lines DL2*j* and DL2(*j*+1) which are not shared between the two or more subpixels R and G within the unit pixels PX1 to PX4. However, the present embodiment is not limited thereto.

In this embodiment, two adjacent unit pixels (PX1 and PX2, PX3 and PX4) share the second data lines DL2*j* and DL2(*j*+1). That is, the second data line DL2*j* or DL2(*j*+1) is connected to at least one subpixel R or G of the subpixels R, G, and B of the corresponding unit pixels (PX1 and PX3, or PX2 and PX4) and is connected to at least one subpixel (R and B, or G and B) of the subpixels R, G, and B of the adjacent unit pixels (PX2 and PX4, or PX1 and PX3). For example, the subpixels R and B connected to the first gate lines GL1*i* and GL1(*i*+1) are connected to the same single second data line DL2*j*, and the subpixels G and B connected to the second gate lines GL2*i*, and GL2(*i*+1) are connected to the same single second data line DL(2*j*+1). That is, between the adjacent unit pixels (PX1 and PX2, PX3 and PX4), the subpixels R, G, and B connected to the same gate line GL1*i* and GL1(*i*+1) are connected to the same one second data lines DL2*j* and DL(2*j*+1).

In addition, the second data line which applies the reference voltage as well as the data signal to the subpixels R, G, and B apply the data signal to the connected subpixels R, G, and B when the gate signal is applied to any one of the first gate lines GL1*i* and GL1(*i*+1) and the second gate lines GL2*i* and GL2(*i*+1), and apply the reference voltage to the connected subpixels R, G, and B when the gate signal is applied to other one of the first gate lines GL1*i* and GL1(*i*+1) and the second gate lines GL2*i* and GL2(*i*+1).

As described above, in an embodiment of the present invention, because the subpixels R, G, and B share the data line and a reference voltage line, the number of vertical lines constituting on the display panel 50 can be reduced. Therefore, because the number of vertical lines traversing the display panel 50 is reduced, an opening ratio allowing light generated from the light emitting devices LD within the subpixels R, G, and B to be emitted to the outside can be obtained. Further, obtaining the opening ratio increases the light emission efficiency of the light emitting device LD, so that the image quality of the display device 1 is improved and manufacturing cost and power consumption is reduced. Also, the reduction of the number of vertical lines reduces the size and number of the data driver 30 controlling the vertical lines, thereby reducing the size and manufacturing cost of the display device 1.

Hereinafter, a method for driving the display device 1 will be described in more detail. In particular, FIG. 4 is a timing diagram illustrating signals applied to the display device shown in FIG. 3. That is, FIG. 4 illustrates an embodiment of a driving waveform supplied to the unit pixels PX1 to PX4 of FIG. 3 for two frames F1 and F2. In addition, FIGS. 5 to 8 are views illustrating driving states of the pixels according to the timing diagram shown in FIG. 4.

Figure 5:
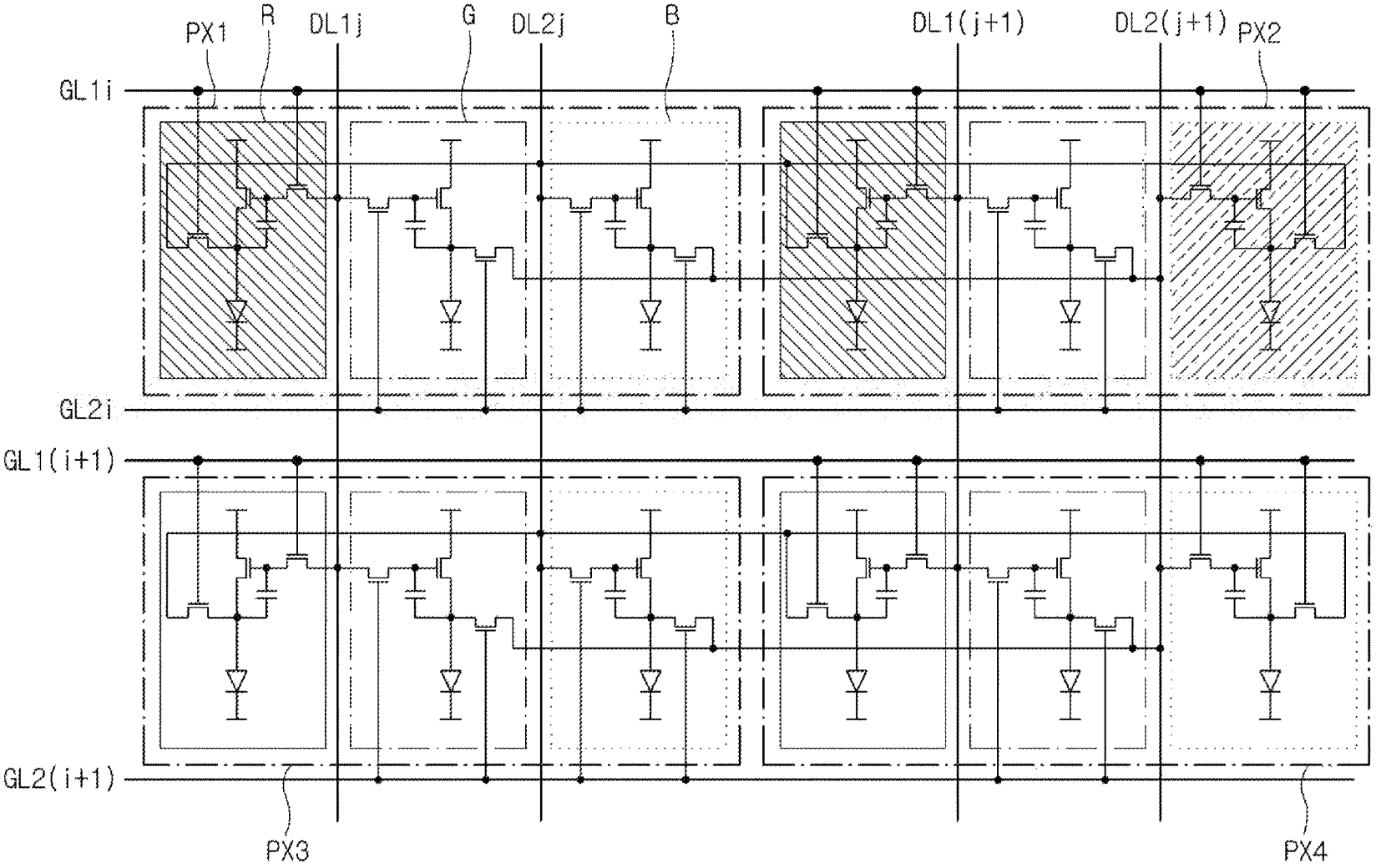
FIGS. 5 to 8 are views illustrating driving states of pixels according to the timing diagram shown in FIG. 4.

Referring to FIGS. 4 and 5, a gate signal is applied to the first gate line GL1*i* connected to the i-th pixel row during a first period t1 of the first frame F1. Then, the first and second switching transistors ST1 and ST2 of the red subpixel R of the first unit pixel PX1 and the red and blue subpixels R and B of the second unit pixel PX2, which are connected to the first gate line GL1*i*, are turned on.

Further, a data signal for the red subpixel R is applied to the first data lines DL1*j* and DL1(*j*+1) connected to the j-th and j+l-th pixel columns during the first period t1. In addition, a data signal for the blue subpixel B is applied to the second data line DL2(*j*+1) connected to the j+1-th pixel column. The data signal is connected to the first data lines DL1*j* and DL1(*j*+1) and the second data line DL2(*j*+1) and is supplied to the first node N1 through the switching transistor ST1 of the subpixels R and B to which the gate signal is applied.

During the first period t1, the reference voltage Vref is further applied to the second data line DL2*j* connected to the j-th pixel column. Also, the reference voltage Vref is connected to the second data line DL2*j* and is supplied to the second node N2 through the second switching transistor ST2 of the subpixels R and B to which the gate signal is applied.

As a result, a voltage corresponding to a difference between the data signal and the reference voltage Vref can be stored in the storage capacitor Cst of the subpixels R and B to which the gate signal is applied during the first period t1, that is, the red subpixel R of the first unit pixel PX1 and the red and blue subpixels R and B of the second unit pixel PX2.

Figure 6:
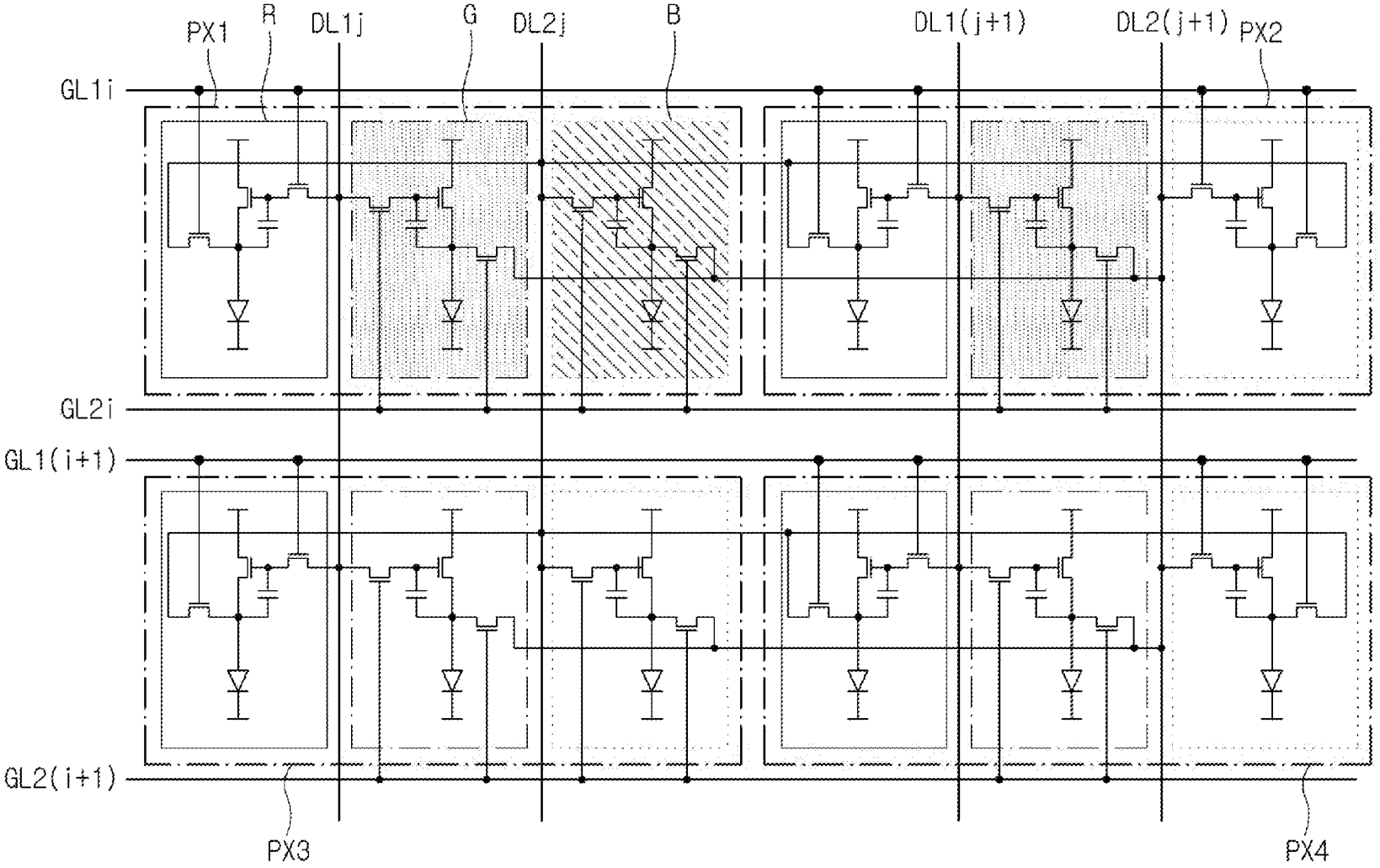

Referring to FIGS. 4 and 6, a gate signal is applied to the second gate line GL2*i* connected to the i-th pixel row during a second period t2 of the first frame F1. Then, the first and second switching transistors ST1 and ST2 of the green and blue subpixels G and B of the first unit pixel PX1 and the green subpixel G of the second unit pixel PX2, which are connected to the second gate line GL2*i*, are turned on.

Further, a data signal for the green subpixel G is applied to the first data lines DL1*j* and DL1(*j*+1) connected to the j-th and j+1-th pixel columns during the second period t2. In addition, a data signal for the blue subpixel B is applied to the second data line DL2*j* connected to the j-th pixel column. Also, the data signal is connected to the first data lines DL1*j* and DL1(*j*+1) and the second data line DL2*j* and is supplied to the first node N1 through the switching transistor ST1 of the subpixels G and B to which the gate signal is applied.

During the second period t2, the reference voltage Vref is further applied to the second data line DL2(*j*+1) connected to the j+1-th pixel column. The reference voltage Vref is connected to the second data line DL2(*j*+1) and is supplied to the second node N2 through the second switching transistor ST2 of the subpixels G and B to which the gate signal is applied.

As a result, a voltage corresponding to a difference between the data signal and the reference voltage Vref can be stored in the storage capacitor Cst of the subpixels G and B to which the gate signal is applied during the second period t2, that is, the green and blue subpixels G and B of the first unit pixel PX1 and the green subpixel G of the second unit pixel PX2.

As described above, for the first frame F1, a voltage can be charged in the subpixels R, G, and B disposed in the i-th pixel row in response to the data signal. The light emitting device LD of the subpixels R, G, and B disposed in the i-th pixel row can then emit light with a luminance corresponding to the charged voltage.

Figure 7:
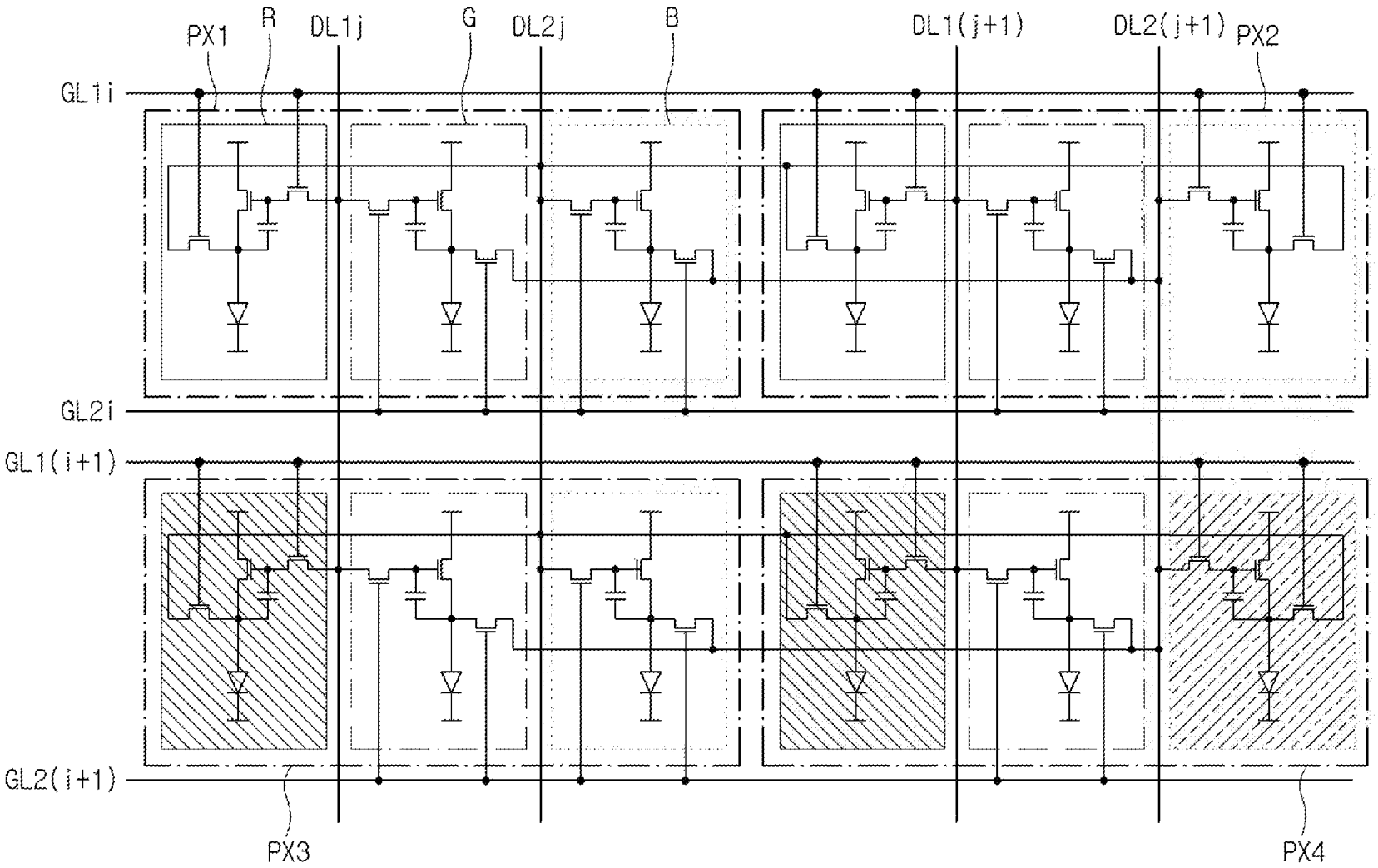

Next, referring to FIGS. 4 and 7, a gate signal is applied to the first gate line GL1(*i*+1) connected to the i+1-th pixel row during a third period t3 of the second frame F2. Then, the first and second switching transistors ST1 and ST2 of the red subpixel R of the third unit pixel PX3 and the red and blue subpixels R and B of the fourth unit pixel PX4, which are connected to the first gate line GL1(*i*+1), are turned on.

A data signal for the red subpixel R is applied to the first data lines DL1*j* and DL1(*j*+1) connected to the j-th and j+l-th pixel columns during the third period t3. In addition, a data signal for the blue subpixel B is applied to the second data line DL2(*j*+1) connected to the j+1-th pixel column. Also, the data signal is connected to the first data lines DLlj and DL1(*j*+1) and the second data line DL2(*j*+1) and is supplied to the first node N1 through the switching transistor ST1 of the subpixels R and B to which the gate signal is applied.

During the third period t3, the reference voltage Vref is further applied to the second data line DL2*j* connected to the j-th pixel column. The reference voltage Vref is connected to the second data line DL2*j* and is supplied to the second node N2 through the second switching transistor ST2 of the subpixels R and B to which the gate signal is applied.

As a result, a voltage which corresponds to a difference between the data signal and the reference voltage Vref can be stored in the storage capacitor Cst of the subpixels R and B to which the gate signal is applied during the third period t3, that is, the red subpixel R of the third unit pixel PX3 and the red and blue subpixels R and B of the fourth unit pixel PX4.

Figure 8:
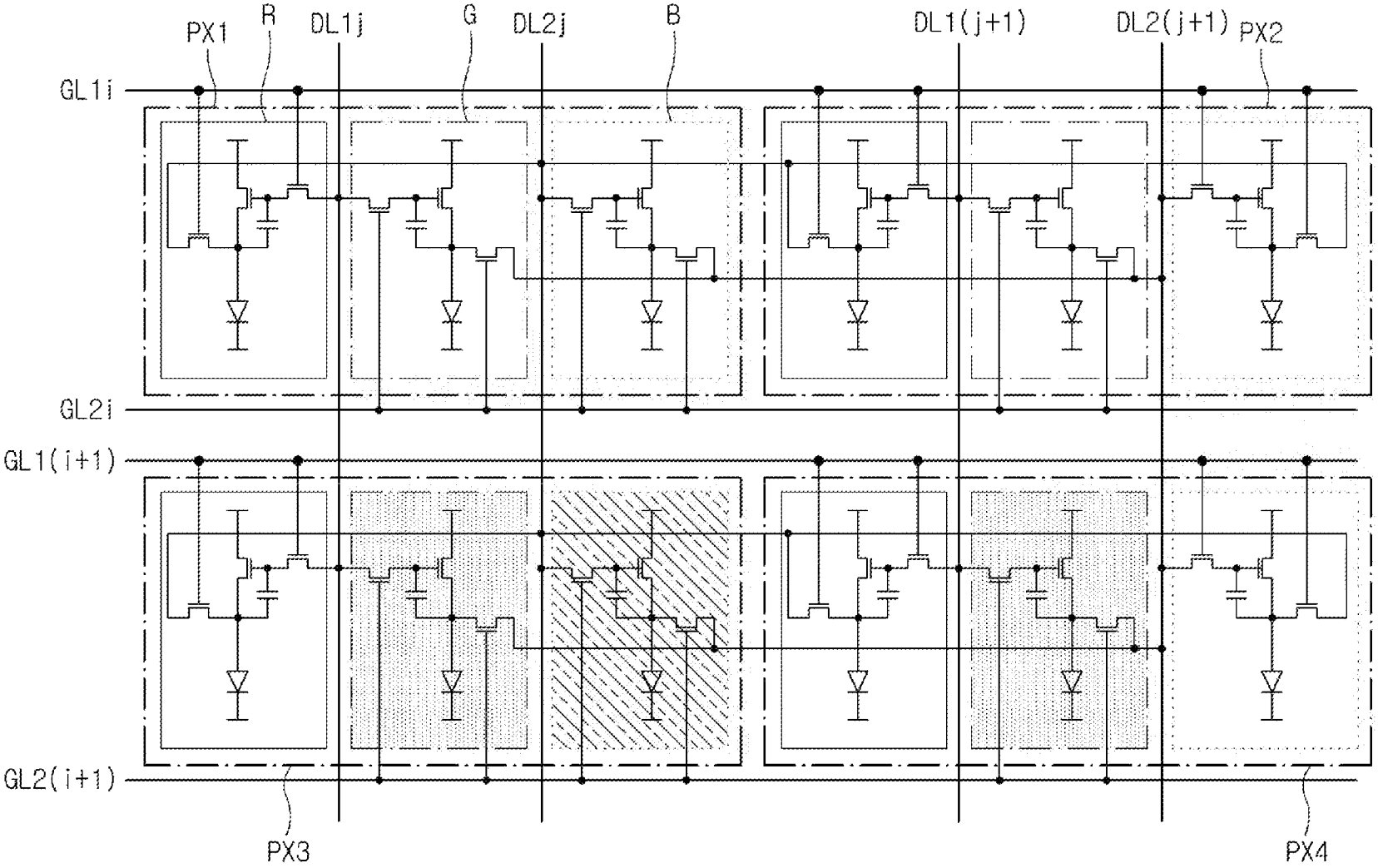

Referring to FIGS. 4 and 8, a gate signal is applied to the second gate line GL2(*i*+1) connected to the i+1-th pixel row during a fourth period t4 of the second frame F2. Then, the first and second switching transistors ST1 and ST2 of the green and blue subpixels G and B of the third unit pixel PX3 and the green subpixel G of the fourth unit pixel PX4, which are connected to the second gate line GL2(*i*+1), are turned on.

Further, a data signal for the green subpixel G is applied to the first data lines DLlj and DL1(*j*+1) connected to the j-th and j+1-th pixel columns during the fourth period t4. In addition, a data signal for the blue subpixel B is applied to the second data line DL2*j* connected to the j-th pixel column. The data signal is connected to the first data lines DLlj and DL1(*j*+1) and the second data line DL2*j* and is supplied to the first node N1 through the switching transistor ST1 of the subpixels G and B to which the gate signal is applied.

During the fourth period t4, the reference voltage Vref is further applied to the second data line DL2(*j*+1) connected to the j+1-th pixel column. The reference voltage Vref is connected to the second data line DL2($j$+1) and is supplied to the second node N2 through the second switching transistor ST2 of the subpixels G and B to which the gate signal is applied.

As a result, a voltage corresponding to a difference between the data signal and the reference voltage Vref can be stored in the storage capacitor Cst of the subpixels G and B to which the gate signal is applied during the fourth period t4, that is, the green and blue subpixels G and B of the third unit pixel PX3 and the green subpixel G of the fourth unit pixel PX4.

As described above, for the second frame F2, a voltage can be charged in the subpixels R, G, and B disposed in the i+1-th pixel row in response to the data signal. Thus, the light emitting device LD of the subpixels R, G, and B disposed in the i+1-th pixel row can emit light with a luminance corresponding to the charged voltage.

According to the display device and the method for driving the same according to an embodiment, an opening ratio of the display panel can be obtained by reducing the number of the data lines and a manufacturing cost of the display device can be reduced by reducing the size of the data driver. Further, the number of the data lines is reduced, so that it is possible to prevent a problem that a gate signal is delayed by a capacitance between the data line and the gate line.

It can be understood by those skilled in the art that the embodiments can be embodied in other specific forms without departing from its spirit or essential characteristics. Therefore, the foregoing embodiments and advantages are merely exemplary and are not to be construed as limiting the present invention. It can be understood by those skilled in the art that the embodiments can be embodied in other specific forms without departing from its spirit or essential characteristics. Therefore, the foregoing embodiments and advantages are merely exemplary and are not to be construed as limiting the present invention. The scopes of the embodiments are described by the scopes of the following claims rather than by the foregoing description. All modification, alternatives, and variations derived from the scope and the meaning of the scope of the claims and equivalents of the claims should be construed as being included in the scopes of the embodiments.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

What is claimed is:

1. A display device comprising:

a gate driver configured to apply gate signals to a plurality of gate lines;

a data driver configured to apply data signals and a reference voltage to a plurality of data lines; and a display panel including a plurality of unit pixels, each unit pixel including a plurality of subpixels emitting different colors, wherein a first data line of the plurality of data lines is connected to a first subpixel and a second subpixel in a first unit pixel, wherein a second data line of the plurality of data lines is connected to the first subpixel and a third subpixel in the first unit pixel, wherein the data driver applies a first data signal to the first data line during a first time period in a first frame, and wherein the data driver applies a reference signal to the second data line during the first time period in the first frame.

2. The display device of claim 1, wherein the first subpixel and the second subpixel are adjacent to each other, and wherein the second subpixel and the third subpixel are adjacent to each other.

3. The display device of claim 1, wherein a number of data lines per unit pixel is equal to a number of subpixels in the unit pixel minus 1.

4. The display device of claim 1, wherein a first gate line of the plurality of gate lines is connected to the first subpixel in the first unit pixel, and wherein a second gate line of the plurality of gate lines is connected to the second subpixel and the third subpixel in the first unit pixel.

5. The display device of claim 4, wherein the unit pixel further comprises:

a second unit pixel including a fourth subpixel, a fifth subpixel and a sixth subpixel, wherein a third data line of the plurality of data lines is connected to the third subpixel and the fourth subpixel in the second unit pixel, and wherein a fourth data line of the plurality of data lines is connected to the fifth subpixel and the sixth subpixel in the second unit pixel.

6. The display device of claim 5, wherein the fourth data line is further connected to the second subpixel and the third subpixel in the first unit pixel, and wherein the second data line is further connected to the fourth subpixel and the sixth subpixel in the second unit pixel.

7. The display device of claim 6, wherein the first gate line is connected to the first subpixel in the first unit pixel and the fourth subpixel and the sixth subpixel in the second unit pixel, and wherein the second gate line is connected to the second subpixel and the third subpixel of the first unit pixel and the fifth subpixel in the second unit pixel.

8. The display device of claim 4, wherein the gate driver applies a first gate signal to the first gate line to turn on transistors included in the first subpixel during the first time period such that the first subpixel emits a first color defined by the first data signal.

9. The display device of claim 8, wherein the gate driver does not apply a gate signal to the second gate line during the first time period in the first frame.

10. The display device of claim 8, wherein the data driver applies a second data signal to the first data line during a second time period in the first frame, and wherein the data driver applies a third data signal to the second data line during the second time period in the first frame.

11. The display device of claim 10, wherein the gate driver applies a second gate signal to the second gate line to turn on transistors included in the second subpixel and the third subpixel during the second time period such that the second subpixel emits a second color defined by the second data signal and the third subpixel emits a third color defined by the third data signal.

12. The display device of claim 11, wherein the gate driver does not apply a gate signal to the first gate line during the second time period in the first frame.

13. A method of driving a display device including a display panel in which a first data line is connected to a first subpixel and a second subpixel in a first unit pixel, a second data line is connected to the first subpixel and a third subpixel in the first unit pixel, a first gate line is connected to the first subpixel in the first unit pixel, and a second gate line is connected to the second subpixel and the third subpixel in the first unit pixel, the method comprising:

applying, via a data driver of the display device, a first data signal to the first data line during a first time period in a first frame; and applying, via the data driver, a reference signal to the second data line during the first time period in the first frame.

14. The method of claim 13, wherein the first subpixel and the second subpixel are adjacent to each other, and wherein the second subpixel and the third subpixel are adjacent to each other.

15. The method of claim 13, further comprising:

applying, via a gate driver of the display device, a first gate signal to the first gate line to turn on transistors included in the first subpixel during the first time period such that the first subpixel emits a first color defined by the first data signal.

16. The method of claim 15, wherein the gate driver does not apply a gate signal to the second gate line during the first time period in the first frame.

17. The method of claim 16, further comprising:

applying, via the data driver, a second data signal to the first data line during a second time period in the first frame; and applying, via the data driver, a third data signal to the second data line during the second time period in the first frame.

18. The method of claim 17, further comprising:

applying, via the gate driver, a second gate signal to the second gate line to turn on transistors included in the second subpixel and the third subpixel during the second time period such that the second subpixel emits a second color defined by the second data signal and the third subpixel emits a third color defined by the third data signal.

19. The method of claim 18, wherein the gate driver does not apply a gate signal to the first gate line during the second time period in the first frame.

* * * * *